US005348367A

United States Patent [19]

Mizelle

[11] Patent Number: 5,348,367

[45] Date of Patent: Sep. 20, 1994

[54] RECLINING CHAIR MECHANISM

[75] Inventor: Ned W. Mizelle, High Point, N.C.

[73] Assignee: Lumex, Inc., Bay Shore, N.Y.

[21] Appl. No.: 99,260

[22] Filed: Jul. 29, 1993

Related U.S. Application Data

[63] Continuation of Ser. No. 923,023, Jul. 30, 1992, abandoned, which is a continuation-in-part of Ser. No. 723,925, Jul. 1, 1991, abandoned.

[51] Int. Cl.[5] ..... A47C 1/035

[52] U.S. Cl. ..... 297/83; 297/84; 297/321

[58] Field of Search ..... 297/68, 83, 84, 320–322, 297/374, 376, 377

[56] References Cited

U.S. PATENT DOCUMENTS

| | | | |
|---|---|---|---|
| 2,796,918 | 6/1957 | Luckhardt | 297/321 |
| 2,820,508 | 1/1958 | Lorenz | 297/83 |
| 2,857,954 | 10/1958 | Voelker | 297/83 X |
| 2,929,440 | 3/1960 | Schliephacke . | |
| 2,968,339 | 1/1961 | Hoffman . | |
| 3,094,353 | 6/1963 | Mizelle . | |
| 3,100,668 | 8/1963 | Mizele . | |
| 3,107,117 | 10/1963 | Mizelle . | |
| 3,114,573 | 12/1963 | Mizelle . | |
| 3,128,122 | 4/1964 | Mizelle . | |
| 3,137,521 | 6/1964 | Re . | |
| 3,139,305 | 6/1964 | Mizelle . | |
| 3,190,690 | 6/1965 | Mizelle . | |
| 3,269,769 | 8/1966 | Mizelle . | |
| 3,300,243 | 1/1967 | Mizelle . | |
| 3,302,969 | 2/1967 | Mizelle . | |
| 3,464,736 | 9/1969 | Mizelle . | |
| 3,495,870 | 2/1970 | Mizelle . | |
| 3,558,185 | 1/1971 | Mizelle . | |
| 3,858,938 | 1/1975 | Kristensson et al. | 297/68 X |
| 4,332,417 | 6/1982 | Mizelle . | |

FOREIGN PATENT DOCUMENTS

| | | | |
|---|---|---|---|
| 206571 | 11/1923 | United Kingdom | 297/68 |

*Primary Examiner*—Peter R. Brown

*Attorney, Agent, or Firm*—Davis Hoxie Faithfull & Hapgood

[57] ABSTRACT

A simple and economical six-bar linkage system keeps a reclining chair stable in its closed position, and permits it to assume any degree of recline between slight recline and full recline without need for friction devices or springs. This is accomplished by the stable balance of the linkage. Sequencing devices are likewise not needed; interaction of the components constrain the movement of the linkage, such that there is only one possible path of travel. The six links are: base frame, back frame, seat frame, drive link, carrier link, and legrest. A heart-rest position may be attained with assistance from an attendant.

25 Claims, 10 Drawing Sheets

RECLINING CHAIR MECHANISM

This is a continuation of copending application(s) U.S. patent application Ser. No. 07/923,023 filed on Jul. 30, 1992, now abandoned which is a continuation of U.S. patent application Ser. No. 07/723,925, filed Jul. 1, 1991 now abandoned.

FIELD OF THE INVENTION

The present invention relates to the art of reclining chairs, and more particularly to three-way reclining chairs having six-bar linkages.

BACKGROUND OF THE INVENTION

The linkage mechanism of a reclining chair controls and coordinates movement of the back, seat, and legrest of the chair during reclining action. In the chair's full upright, or closed, position, the legrest is usually positioned just under the seat and at a right angle to the seat. During conventional reclining action, the back angles backward, the legrest extends and raises, and the front of the seat raises. The action is reversed to return the chair to full upright position.

In some cases, the legrest is stored underneath the seat in a horizontal position. In such a configuration, however, the reclining and inclining action of the chair is similar to that for a configuration where the legrest is at a right angle to the seat.

A three-way reclining chair is one in which the back and seat of the chair move relative to each other during reclining movement. In a two-way reclining chair, the back and seat remain fixed relative to each other at all times. Most reclining chairs employ a single four-bar linkage, a combination of two interactive four-bar linkages, or a six-bar linkage. Linkages are composed of links, a link being a rigid piece, usually a bar or plate. An example of a prior art single four-bar linkage may be found in U.S. Pat. No. 2,968,339 to Hoffman. An example of a prior art dual interactive four-bar linkage may be found in U.S. Pat. No. 3,137,521 to Re. An example of a prior art six-bar linkage may be found in U.S. Pat. No. 3,190,690 to Mizelle.

Conventional reclining chairs are balanced toward a bias of three positions: 1) closed, 2) intermediate recline, and 3) full recline. Since the three positions are preset by the manufacturer, the occupant has no freedom to choose the reclining positions most comfortable for him. Additionally, transition between reclining positions is often abrupt and uncomfortable.

Reclining chairs often require the use of springs or friction devices, or both, somewhere in the linkage to balance the chair in the full upright position, so that it does not recline without some effort put forth by an occupant. With wear of the friction devices, the chair will often recline spontaneously when in its full upright position. This situation is exacerbated when the chair is occupied, since more weight is placed on the back of the chair.

In chairs employing two interactive four-bar linkages, sequencing devices are employed to activate the correct linkages at the proper time during reclining movement. These sequencing devices are often used in addition to springs or friction devices, or both, to help balance and move the chair correctly. All of these devices are often noisy and cumbersome, and add to the cost of manufacture. Some friction devices are also prone to prematurely wear the links to which they are attached.

Another problem with many prior art reclining chairs is the difficulty encountered by an elderly or infirm occupant in entering or exiting the chair. Since the front of such chairs serves as the receptacle of the legrest when the chair is in the closed position, the occupant cannot place his feet directly on the floor beneath him when exiting the chair.

Also, most reclining chairs, especially three-way recliners, have complex linkage systems, resulting in high manufacturing costs and significant maintenance difficulties.

There remains the need for a reclining chair mechanism that overcomes the shortcomings associated with the prior art, as described above.

SUMMARY OF THE INVENTION

The present invention provides a reclining chair having a simple and economical six-bar linkage system that is balanced so as to stay in closed position and reclining balance without sequencing devices, friction devices, or springs. The chair's continuing balance allows the occupant to recline the chair to any degree between slightly reclined and fully reclined positions. The invention also eases egress from the chair by allowing the occupant to place his feet directly beneath him.

In accordance with the invention, a reclining chair mechanism comprises a base link, a back link, means for pivotally attaching the base link to the back link, a seat link having a front and a rear, means for pivotally attaching the rear of the seat link to the back link, a drive link having a front and rear, means for pivotally attaching the rear of the drive link to the back link, a legrest link, means for pivotally attaching the legrest link to the front of the seat link, a carrier link, means for pivotally attaching the carrier link to the base link, means for operatively attaching the front of the drive link to the carrier link, and means for operatively attaching the legrest link to the carrier link.

In a principal aspect, the legrest link is positioned at an angle underneath the seat link when the chair is in a full upright position.

Specifically, and in a preferred embodiment, the carrier link is operatively attached to the front of the drive link by pivotally attaching to the front of the drive link, and the carrier link is operatively attached to the legrest link by pivotally attaching the legrest link to the front of the drive link.

In operation of the preferred embodiment, initial activation of the linkage causes the back link to rotate in a first direction, causing the drive link, constrained by the motion of the carrier link, to swing the legrest link out from under the seat link. The chair is now in reclining balance, and the occupant may now assume any position of recline, characterized by further rotation of the back link and legrest link and elevation of the front of the seat link. Full recline is reached when the carrier link, having rotated in said first direction from a full upright position, toggles with the drive link, preventing the latter from moving any farther under the force of rotation of the back link. The movement of the linkage is thus arrested. The reclining action may then be reversed to return the chair to any intermediate reclining position, or to a full upright position.

The links are configured such that initial activation of recline requires some effort on the part of the occupant. Therefore, until the chair is in a slightly reclined position, the chair will tend to return to full upright position. This prevents spontaneous recline of the chair, with no need for external devices.

When the chair is in full recline, an attendant may lift the front of the seat frame and the top of the back frame to bring the chair into "heart-rest" position, a position in which the seat frame, back frame, and legrest assume the position of a lounge chair that has been tilted approximately 45 degrees with the occupant's back, seat, and legs supported. The mechanism permits this position due to the cyclical action of the linkage, i.e., the carrier link continues in said first direction while reversing the direction of rotation of the drive link, legrest link, and back link.

It is an object of the invention to provide a reclining chair that allows the occupant to recline the chair to any degree between slight recline and full recline.

It is a further object of the invention to provide a reclining chair that can operate without springs, friction devices, or sequencing devices.

It is a further object of the invention to provide a reclining chair in which the occupant can place his feet directly beneath him when exiting the chair.

It is a further object of the invention to provide a reclining chair that has a simple and inexpensive linkage system.

These and other objects and advantages of the present invention will become apparent in the following description and accompany drawings.

DETAILED DESCRIPTION OF THE DRAWINGS

The present invention will be described with reference to a reclining chair 10, shown in FIG. 1, but it will be appreciated that the present invention can be used in other reclining chairs as well. In certain embodiments of the present invention, the chair's base, back, seat, and legrest themselves constitute part of the linkage, which, by nature of their width, are components of both side linkage mechanisms at once. Other embodiments of the invention may instead provide side links to be attached to the above-named chair components. The invention's principles of linkage movement are the same in either case. Other embodiments of the invention will be apparent to those skilled in the art.

Figure 1:
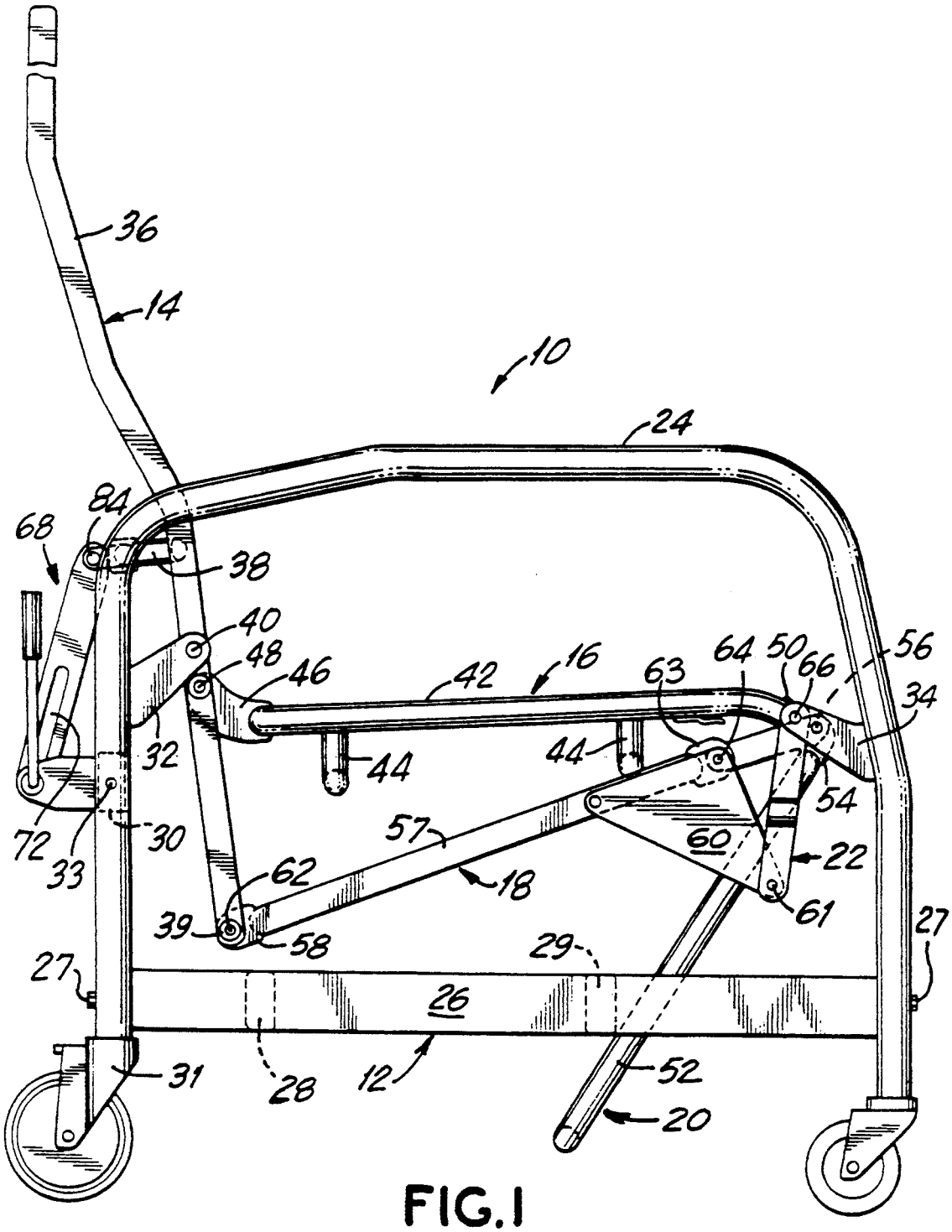
FIG. 1 is a side elevational view of a reclining chair having the preferred embodiment of a reclining chair mechanism of the present invention, showing the chair in a full upright position.
Figure 2:
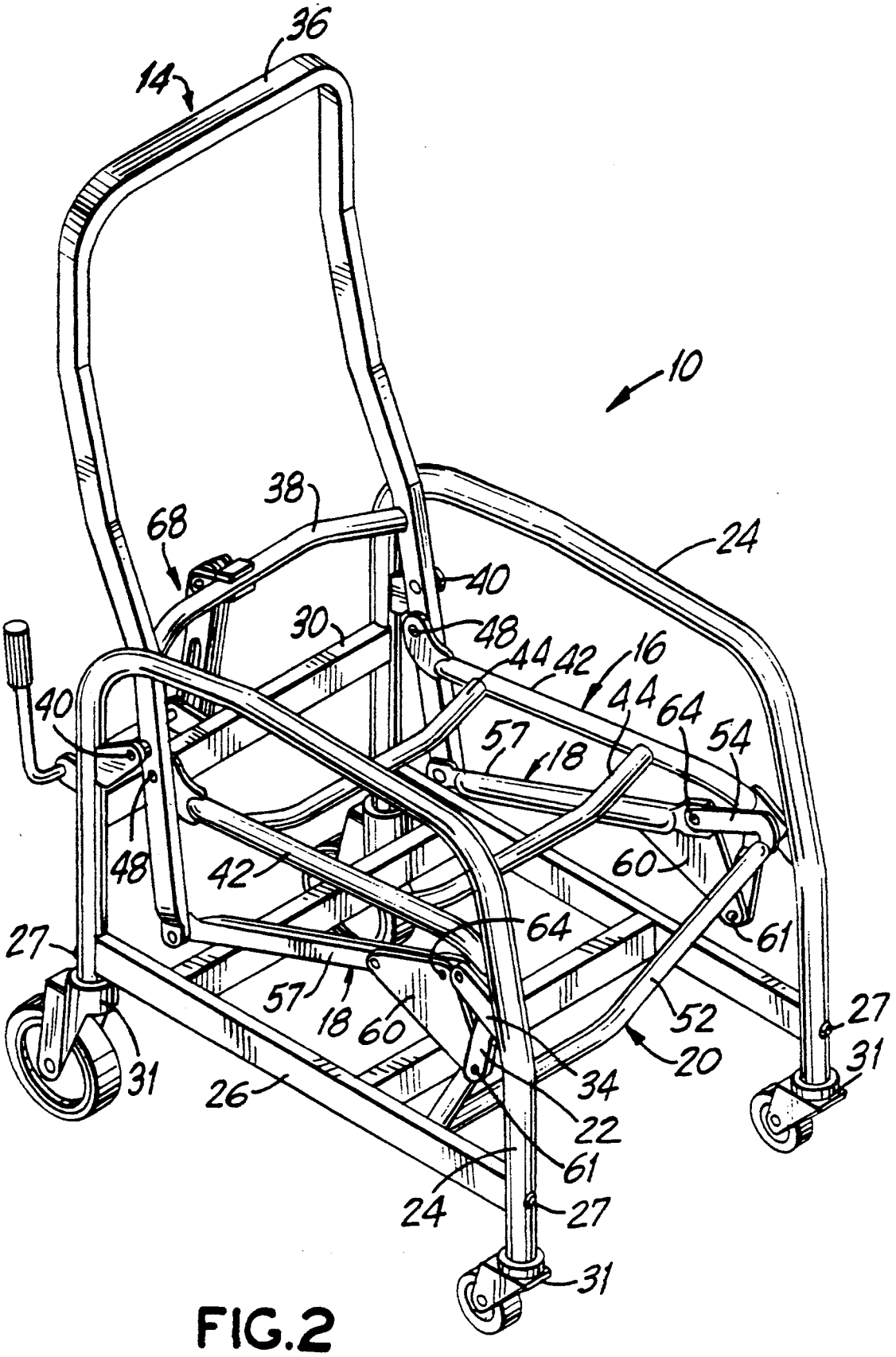
FIG. 2 is a perspective view of the chair of FIG. 1; 3 is a top plan view of the chair of FIG. 1.
Figure 3:
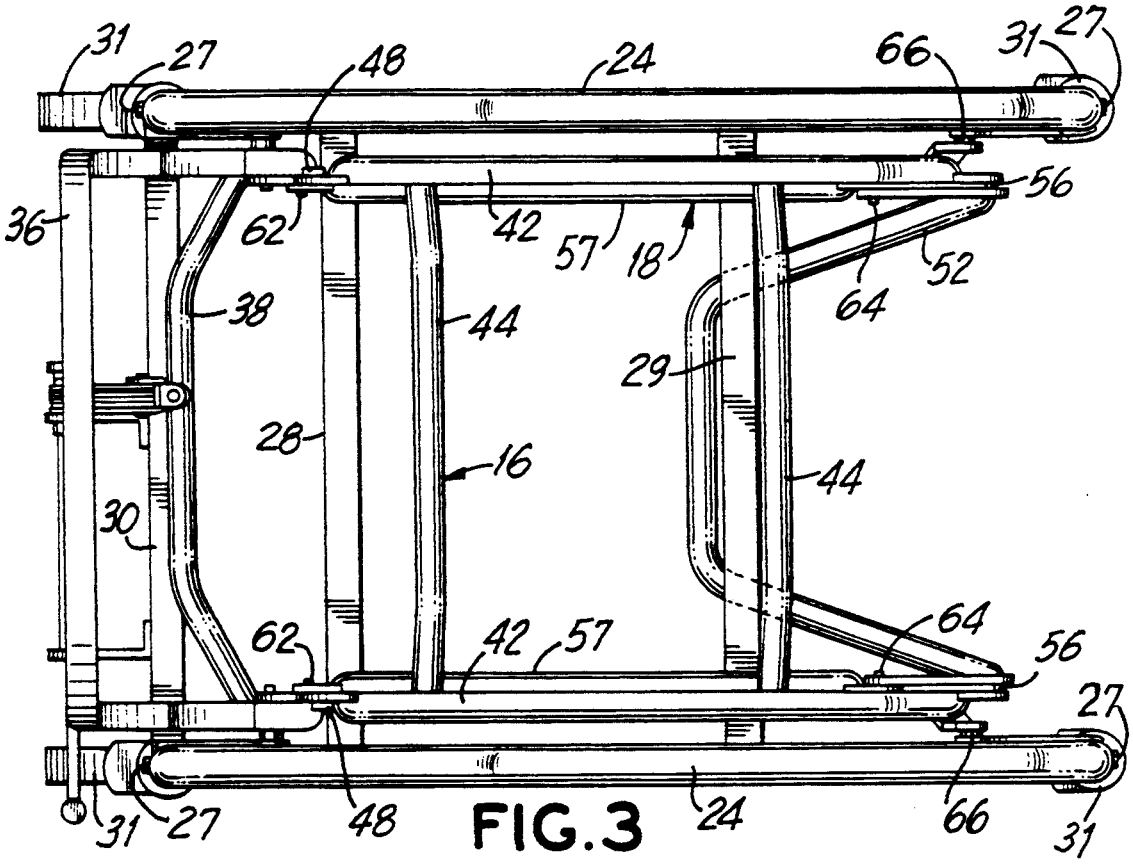

A preferred embodiment of the invention is shown in FIGS. 1–3, which depict a reclining chair 10 in a full upright, or closed, position, having a base frame assembly 12, a back frame assembly 14, a seat frame assembly 16, two drive link assemblies 18, a legrest assembly 20, and two carrier links 22. The base frame assembly 12 comprises two curved armrest bars 24. The intermediate sections of the armrest bars 24 act as the arms of the chair while the end portions of the bars 24 approach the floor. A longitudinal support 26 is bolted, by means of bolts 27 at the front and rear ends of the support 26, to the front and rear lower portions, respectively, of each armrest bar 24. Two cross supports 28 and 29 are welded at their ends to the longitudinal supports 26, thereby forming an H-frame supporting the armrest bars 24. The cross support 28 is disposed toward the rear of the base frame assembly 12, while the cross support 29 is disposed slightly forward of the midpoint of the longitudinal supports 26, whereby the legrest assembly 20 rests against it when the chair 10 is in a full upright position. A locking device support beam 30 is bolted at its ends between the armrest bars 24, a few inches above the H-frame formed by supports 26, 28, and 29, at the rear of the chair 10, by bolts 33. A locking device 68, described below, is mounted on support beam 30 and a back support bar 38, described below.

The armrest bars 24 are composed of 16 gauge steel, cold rolled and electric welded into $1\frac{1}{4}''$ diameter cylindrical tubing. The longitudinal supports 26 and the cross supports 28 are composed of $1'' \times 2''$ 18 gauge steel rectangular tubing. Other material of suitable strength can be used, as is well known. Casters 31 are affixed in a conventional manner to the ends of the armrest bars 24, whereby the chair 10 may easily move over a floor, an inclined ramp, etc.

Two forwardly projecting brackets 32 are welded to the inside surfaces of the rear sections of the armrest bars 24, and two rearwardly projecting brackets 34 are welded to the inside surfaces of the forward sections of the armrest bars 24. The brackets 32 and 34 consist of generally flat steel plates with an offset curvature and a curvature where they attach to the armrest bars 24.

The back frame assembly 14 comprises a U-shaped bar 36, the arms of which are generally straight with slight curves to increase comfort, and generally vertical when the chair 10 is in closed position. A back support bar 38 connects the arms of the U-shaped bar 36 at points located slightly above the brackets 32 of the armrest bars 24. The U-shaped bar 36 and the back support bar 38 are composed of $1\frac{1}{4}'' \times \frac{5}{8}''$16 gauge steel flat oval tubing. The tubing is flattened at the ends of the arms of the U-shaped bar 36 to form plates 39.

The brackets 32 of the armrest bars 24 pivotally attach to the arms of the U-shaped bar 36 at pivot points 40. In the preferred embodiment, the pivot points 40 each comprise a removable nylon shoulder brushing disposed through one of the brackets 32 and one arm of the U-shaped bar 36. The other pivot points of the chair 10 permanently riveted in the preferred embodiment, although other means of pivotal attachment will be apparent to those skilled in the art. All embodiments of the present invention described herein employ pivot points of similar construction to the corresponding pivot points in the chair 10.

The seat frame assembly 16 comprises two length supports 42 and two cross supports 44, all made of 16 gauge steel, $\frac{7}{8}''$ diameter cylindrical tubing in the preferred embodiment. The tubing is flattened at the back end of each length support 42 to form flat curved plates 46. The curved plates 46 are pivotally attached in the above-described manner to the back frame assembly 14 at pivot points 48, which are located 1,216" below pivot points 40 when the chair 10 is in full upright position. This arrangement of pivot points 48 below pivot points 40 is preferred, but the invention also contemplates attachment of the seat frame assembly 16 to the back frame assembly 14 at other distances, or at pivot points which are level with or slightly above pivot points 40, either on the armrest bars 24 or on brackets protruding therefrom. For example, in the embodiment of FIGS. 9–11, the attachment of the seat frame assembly to the back frame assembly is level with the attachment of the back frame assembly to the base frame assembly.

The length supports 42 of the seat frame assembly 16 are straight except for the curved plates 46 on their back ends and a slight downward curve near their front ends. The tubing of the length supports 42 in the preferred embodiment is flattened at the front end of each length support 42 to form plates 50. The two cross supports 44 are welded at their ends to the length supports 42 and curve downwardly at their middle to accommodate body shape and padding. The cross supports 44 and the length supports 42 thus form an H-frame. The seat frame assembly 16 is generally horizontal when the chair 10 is in full upright position, as shown in FIGS. 1 and 2.

The legrest assembly 20 comprises a generally U-shaped platform bar 52, made of $\frac{7}{8}''$ diameter 16 gauge steel cylindrical tubing in the preferred embodiment, and two hooked steel plates 54. One arm of each hooked plate 54 is welded to each end of the platform bar 52, and curved to accommodate the shape of the tubing. The apices of the hooked plates 54 are pivotally attached to the plates 50 of the seat frame assembly 16 at pivot points 56, located 20,588" from pivot points 48, which attach the seat frame assembly 16 to the back frame assembly 14.

When the chair 10 is in a full upright position, the legrest assembly 20 is angled so that the lower end of the platform bar 52 is tucked underneath the seat frame assembly 16, as shown in FIGS. 1 and 2. This positioning of the legrest assembly 20 allows the occupant to place his feet underneath the chair 10, thereby more directly supporting his weight during egress. The legrest assembly 20 may be angled in the closed position anywhere from 0 to 90 degrees relative to vertical, as desired.

Each drive link assembly 18 comprises, in the preferred embodiment, a length of straight 16 gauge steel $\frac{7}{8}''$ diameter cylindrical tubing 57, flattened at its back end to form a plate 58. The plates 58 are pivotally attached to the plates 39 on the lower ends of the back frame 14 at pivot points 62, which are located 8.187" from pivot points 48. The tubing of the drive link assemblies 18 is flattened at the front ends of the assemblies to form plates 63. The plates 63 are pivotally attached to the ends of the hooked plates 54 of the legrest assembly 20 at pivot points 64, located 3.470" from pivot points 56, which attach the seat frame assembly 16 to the legrest assembly 20. In the preferred embodiment, a steel triangular plate 60 is bolted to the front end of each drive link 18 to form an offset or bellcrank point 61, 4.559" from pivot points 64. Bars forming a triangle or other suitable means of providing a bellcrank point could be used.

The carrier links 22 are preferably composed of 0.150" flat sheet steel elongated plates, and are positioned slightly behind vertical when the chair 10 is in the full upright position of FIGS. 1–3. The top ends of the carrier links 22 are pivotally attached to the brackets 34 protruding from the armrest bars 24 at pivot points 66. The bottom ends of the carrier links 22 are pivotally attached to the bellcrank points 61 on the triangular plates 60, 5.787" from pivot points 66.

The width of the chair 10 may be varied without affecting the movement of the linkage. The distance between the pivot points may also be varied while retaining the nature of linkage movement herein described, and contemplated by the invention, as will be apparent to those skilled in the art.

Although the described arrangement of the drive link assemblies 18, carrier links 22, and legrest assembly 20 is preferred, it may be varied while still remaining within the scope of the invention and retaining the advantages thereof. For example, the legrest assembly 20 may be attached to the carrier links 22 instead of the drive links 18. The bellcrank plates 60 may be eliminated, if desired, whereby the carrier links 22 may be attached to other points on the drive links 18, or on the legrest 20, or on pivot points 64 themselves, as in the embodiment of FIGS. 9–11. Other bellcrank points may be provided in other locations in the linkage, and on other links. The platform bar 52 of the legrest assembly 20 may be eliminated if a legrest is not desired, whereby the hooked plates 54 would act as connector links. Other variations and modifications will be apparent to those skilled in the art.

Figure 4:
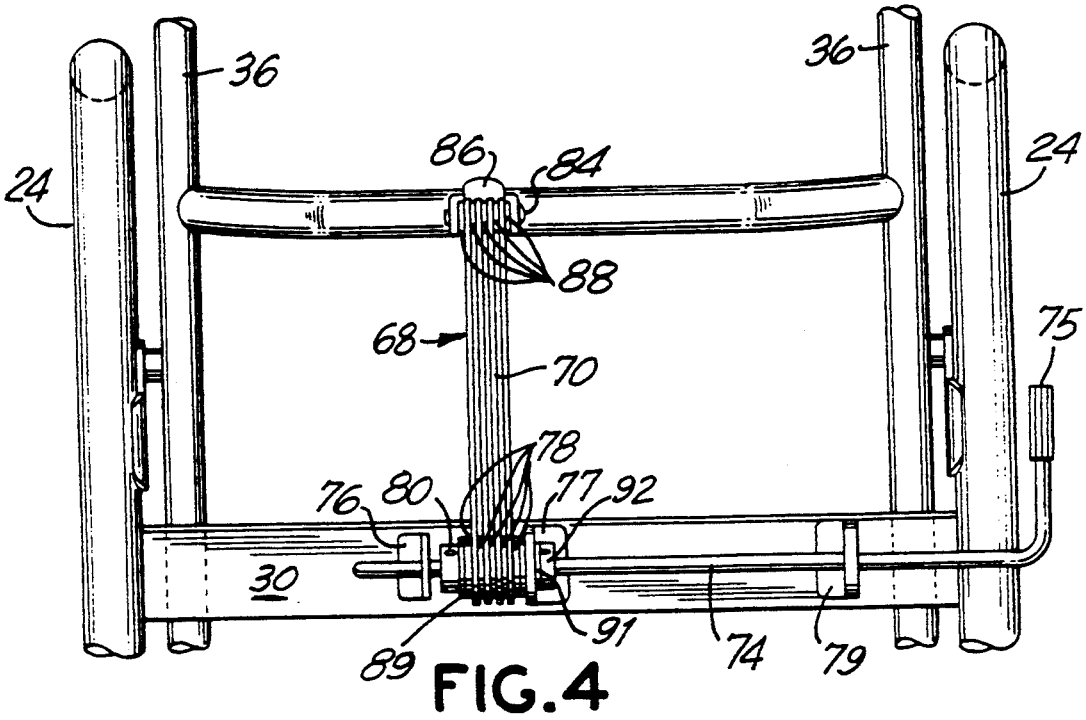
FIG. 4 is a perspective view of an optional friction/-locking device for use with the chair of FIG. 1.

Referring now to FIG. 4, in the preferred embodiment an optional friction and locking device 68 is attached to the rear of the chair 10. Friction devices are not needed to balance the chair 10 in reclining position or to stabilize it in closed position, as the inherent balance of the linkage accomplishes those ends. However, it is useful for some applications, as will be described below.

The locking device 68 preferably comprises a plurality of baffle plates 70, though one would suffice, each having a slot 72 (FIG. 1) slidably engaged on a rod 74. The rod 74 is mounted on two prongs 76 and 77, which are welded to and protrude from the locking device support beam 30. The rod 74 is screwed into the prong 77, but turns freely in prong 76. The baffle plates 70 are disposed between the prongs 76 and 77. Flat nylon washers 78 are mounted on the rod 74 between the plates 70 and on the outer surfaces thereof. The washers 78 act as compressors in the locking device 68. A third prong 79 is welded to and protrudes from support beam 30, and is located apart from the prongs 76 and 77 toward the right of the chair 10. The rod 74 is also mounted on the prong 79, and turns freely in it. Prong 79 serves to stabilize the rod 74. The end of the rod 74 is bent to form a handle 75 at the right side of the chair 10. When the locking device 68 is in the unlocked position, the handle 75 points upwardly.

A steel washer 89 is provided on the rod 74 at the side of the nylon washers 78 facing the prong 76. A locking clamp collar 80 locks the washer 89 snugly against the washers 78. The side of the nylon washers facing prong 77 press slightly against the latter when the locking device 68 is in the unlocked position. On the other side of prong 77 are mounted on the rod 74 a steel washer 91 and a locking clamp collar 92, which press against the prong 77 when the locking device 68 is in the unlocked position.

Other means of compressing the washers 78 may be used, such as a foot pedal disposed on the bolt 74, said foot pedal having a cammed surface facing the washers 78, whereby the cam presses against the washers 78 when the foot pedal is depressed.

The baffle plates 70 are pivotally mounted on a clevis pin 84 at their opposite end. The pin 84 is mounted on a two-pronged bracket 86, which is welded to the back support bar 38, with a hair spring cotter pin. A second set of nylon washers 88 is mounted on the pin 84 between the plates 70 and on the outside surfaces thereof. If desired, the washers 88 may be compressed to slow or prevent rotational movement of the baffle plates 70 around the pin 84.

In operation of the friction and locking device 68, as the chair 10 reclines, the back support bar 38 moves relative to the support beam 30, causing the baffle plates 70 to slidably move along their slots 72 relative to the rod 74 and the nylon washers 78. If it is desired to require more energy to be expended in recline of the chair 10, slowing reclining movement thereof, than movement of the linkage without a friction device, the locking clamp collar 86 is placed to press the nylon washers 78 against the prong 77 when the device 68 is in unlocked position. If it is desired to lock the linkage against reclining movement of any kind, the occupant, or an attendant, moves the handle 75 from an upwardly pointing position to a downwardly pointing position. This action rotates the rod 74, causing it to screw out of the prong 77 toward the right (the screw threads of the prong 77 and rod 74 being configured to accomplish that end). This action, in turn, causes the nylon washers 78 to press forcefully against prong 77, and press baffle plates 70 forcefully between them, preventing the latter's sliding movement. The linkage is unlocked by reversing the movement of the handle 75. Such locking is necessary if it is desired to put the chair into a heart-rest position, as described below. It is also helpful if the chair is transported while in a reclining position.

To initially recline the chair 10, the occupant must press against the back frame assembly 14 while pressing against the floor with his feet or against the armrest bars 24 with his hands or arms. The linkage is arranged whereby initial recline requires some effort, thereby guarding against spontaneous recline. The initial activation of recline continues until the linkage is approximately in the transport position, shown in FIG. 5, which is convenient for lounging or translational movement. The chair 10 is in reclining balance from transport position to fully reclined position, shown in FIG. 7. An occupant of the chair 10 may thus move the chair 10 from transport position to any degree of recline merely by bending or straightening at the waist or knees, or both.

If the chair 10 is used for transport while in the transport position or other reclining position, use of the friction and locking device 68, or other suitable locking device, is recommended to prevent movement of the linkage.

Figure 5:
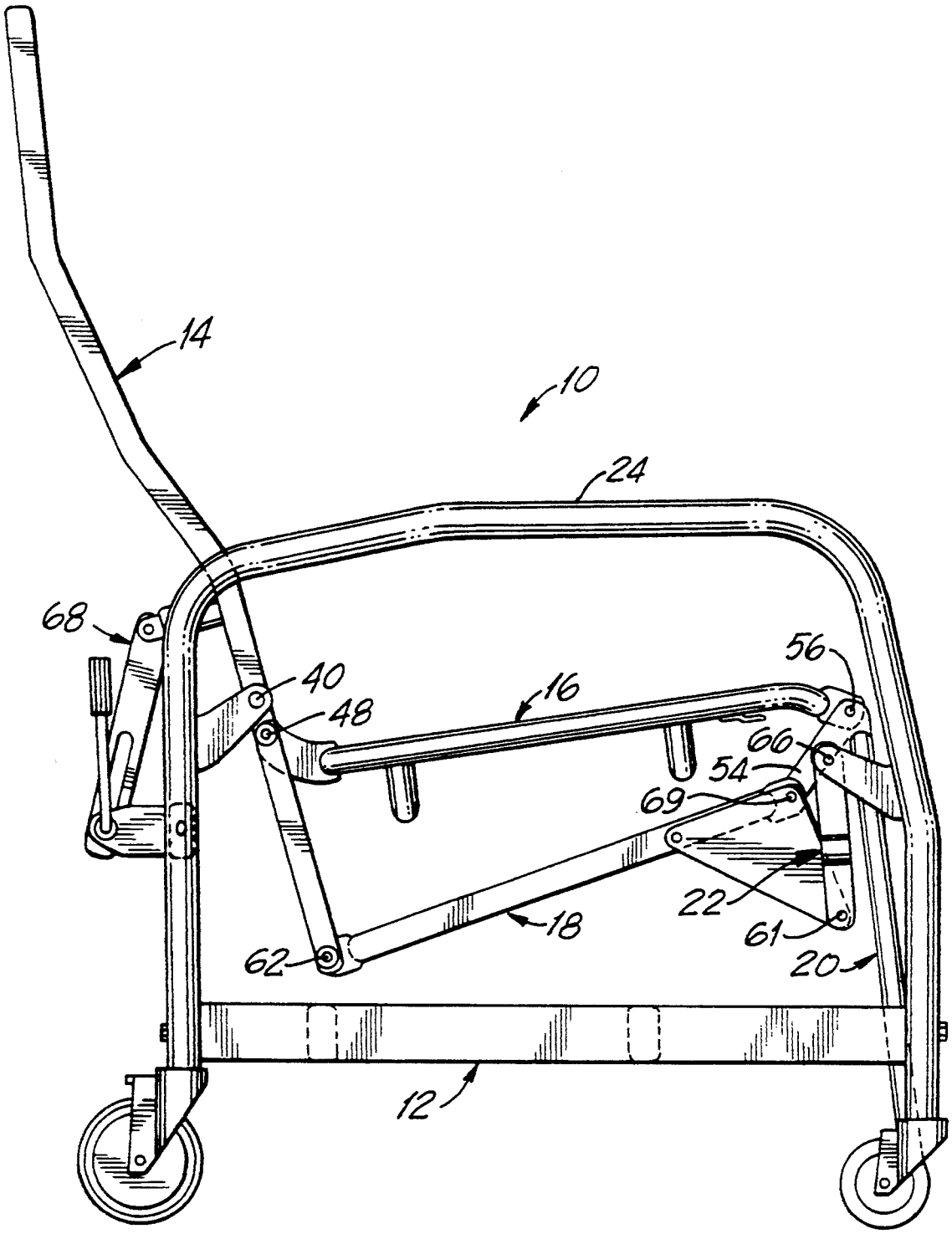
FIG. 5 is a side elevational view of the chair of FIG. 1, with the chair in transport, or slightly reclined, position.

To reach the transport position of FIG. 5 from the full upright position of FIGS. 1–3, the back frame assembly 14 is rotated counter-clockwise around pivot points 40. The drive link assemblies 18 are pushed forward by the bottom of the back frame assembly 14 at pivot points 62. The front ends of the drive link assemblies 18, at the bellcrank points 61, cause the bottom of the carrier links 22 to rotate about the base frame assembly 12 at pivot points 66 from an initial angle behind vertical to a slightly forward of vertical. The movement of the carrier links 22 in turn forces the bellcrank points 61 of the drive link assemblies 18 down slightly. The seat frame assembly 16 moves forward slightly, pushed forward by the back frame assembly 14 at pivot points 48.

Since the seat frame assembly 16 moves forward less than the drive link assemblies 18, the front end of the seat frame assembly 16 is raised by the forward movement of the drive link assemblies 18. This action is caused by the forward movement of the drive link assemblies 18, which pushes forward the ends of the hooked plates 54 of the legrest assembly 20, at pivot points 64, causing the legrest assembly 20 to rotate around pivot points 56, which attach the apices of the hooked plates 54 to the front of the seat frame assembly 16. Due to the rotationally changed position of the hooked plates 54, the vertical component of the constant distance between pivot points 64 at the front ends of the drive link assemblies 18, and pivot points 56 at the front ends of the seat frame assembly 16, is greater than when the chair 10 is in full upright position. Since the downward movement of the front of the drive links 18 is constrained by the carrier links 22, the forward end of the seat frame 16 is forced up. As explained above, however, the carrier links 22 do cause some downward movement of the front of the drive links 18, reducing the distance the front end of the seat frame 16 is raised.

The forward movement of the drive link assemblies 18 also causes the legrest assembly 20 to rotate a relatively great distance, as compared to the movement of the rest of the linkage, out from under the seat frame assembly 16. The legrest assembly 20 rotates from an angle behind vertical to an angle slightly forward of vertical.

The chair 10 is stable in the full upright position shown in FIGS. 1–3, i.e, it has no tendency spontaneously to recline. The balance of the linkage is such that the chair 10 tends toward full upright position if placed in any position between full upright and transport positions. This stability is due to the relatively fast initial travel of the legrest assembly 20 required to reach transport position, compared to the back frame assembly 14 and seat frame assembly 16. The stability is also due to the fact that the carrier links 22 do not pass their balance points until transport position is reached.

After the transport position shown in FIG. 5 is reached, the initial activation stage is completed and the chair 10 is in reclining balance. The occupant may now assume any position between transport position and full recline by bending or straightening at the waist or knees, or both.

Figure 6:
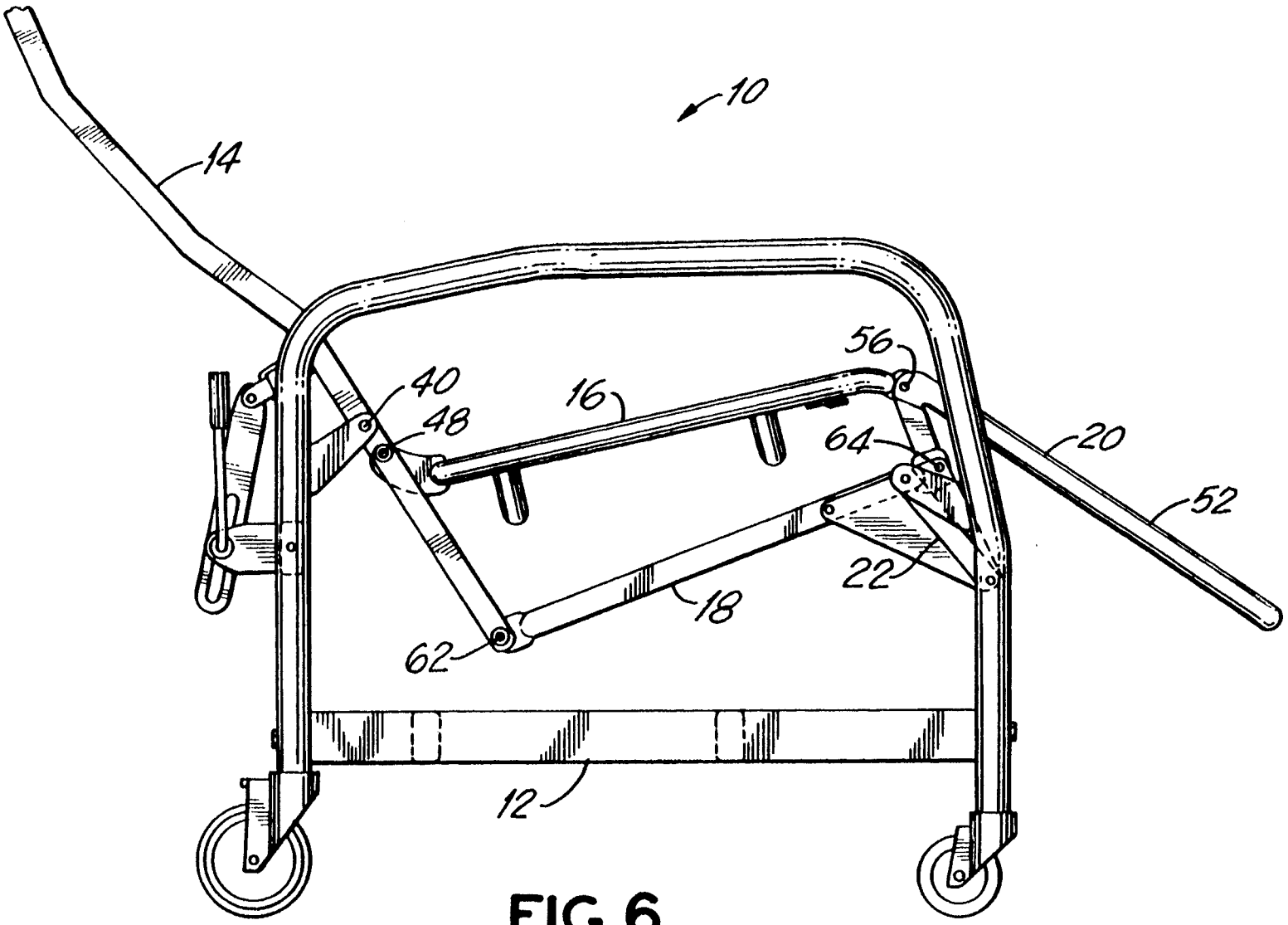
FIG. 6 is a side elevational view of the chair of FIG. 1, with the chair in an intermediate recline position.

FIG. 6 shows the chair 10 in an exemplary intermediate recline position. To reach this position, the occupant straightens his waist and knees and presses against the back frame assembly 14, causing it to again rotate counter-clockwise around pivot points 40. The bottom end of the back frame assembly 14 pushes the drive link assemblies 18 forward at pivot points 62, and pushes the seat frame assembly 16 slightly forward at pivot points 48. The drive links assemblies 18, in turn, at bellcrank points 61, force the carrier links 22 to further rotate counter-clockwise from generally vertical to approximately 45 degrees from vertical, thus raising the forward ends of the drive link assemblies 18. Since the seat frame assembly 16 does not move forward as much as the drive link assemblies 18, the legrest assembly 20 rotates counter-clockwise, driven by the drive link assemblies 18 at pivot points 64, around pivot points 56 to an angle at which the platform bar 52 is approximately 40 degrees below horizontal.

The front of the seat frame assembly 16 is raised by the elevation of the front ends of the drive link assemblies 18. The former does not rise as much as the latter, however, since the rotation of the legrest assembly 20 slightly reduces the vertical distance between the pivot points 56 and 64, through which the seat frame assembly 16 and the drive link assemblies 18 are connected.

Figure 7:
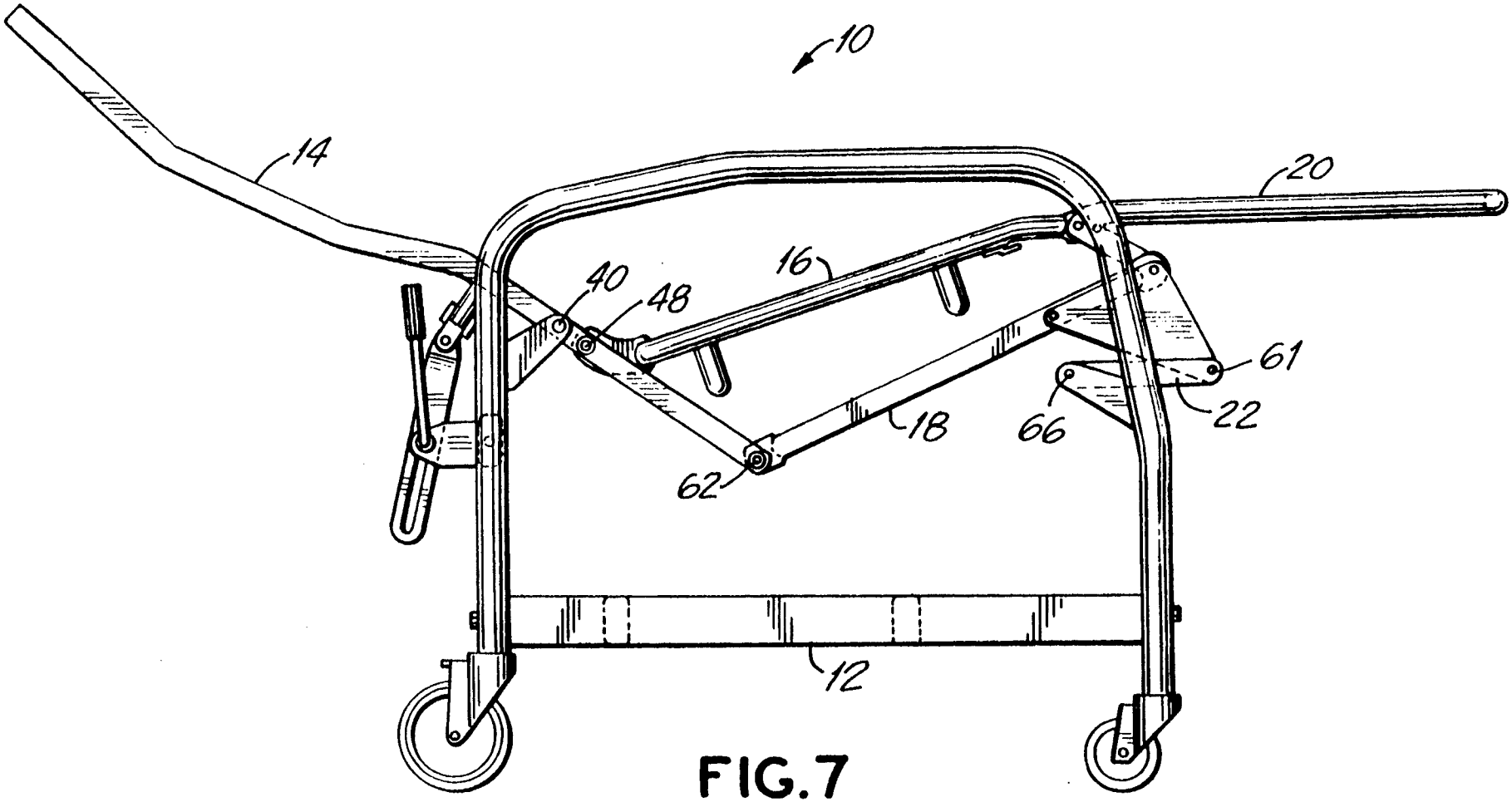
FIG. 7 is a side elevational view of the chair of FIG. 1, with the chair in a fully reclined position.

FIG. 7 depicts the chair 10 in full recline position. To reach this position from the intermediate position shown in FIG. 6, the occupant again presses against the back frame assembly 14 while straightening at the waist and knees. This action causes the back frame assembly 14 to further rotate counter-clockwise about pivot points 40 on the base frame assembly 12, forcing the drive link assemblies 18 forward at pivot points 62. Since pivot points 62 at the bottom of the back frame assembly 14 describe the right side arc of a circle at this point, the drive link assemblies 18 do not move forward to the same degree that they did during initial recline. The seat frame assembly 16 likewise is not pushed forward as much as in initial recline of the chair 10, since pivot points 48, attaching the seat frame assembly 16 to the back frame assembly 14, begin at this point to describe the right side arc of a circle around pivot points 40, imparting less forward movement to the seat frame assembly 16. The bellcrank points 61 at the ends of the carrier links 22 likewise describe the right side arc of a circle around pivot points 66. The drive link assemblies 18 and legrest assembly 20 are not forced forward, but rather are pushed up. The rotation of the legrest assembly 20, therefore, is minimal. The net effect is to raise the front of the seat frame assembly 16 and the legrest assembly 20 while lowering the top of the back frame assembly 14.

At the full recline position shown in FIG. 7, the interaction of the links will not allow further recline of the chair 10. It can be seen that the movement of the bellcrank points 61 during recline describes a circle around the fixed pivot points 66 by means of the carrier links 22, constraining the movement of the drive link assemblies 18. In full recline position, the rotation of the back frame assembly 14 is arrested by that circular motion. Specifically, under the force of the back frame assembly 14 at pivot points 62, the drive link assemblies 18, the front ends of which are constrained through bellcrank points 61 to the circular motion of the carrier links 22, assume a position close to parallel to that of the carrier links 22. The drive link assemblies 18 are unable to move forward any farther, and thus arrest the counter-clockwise rotation of the back frame assembly 14. The full range of reclining positions reachable by the occupant's effort alone has now been spanned.

Figure 8:
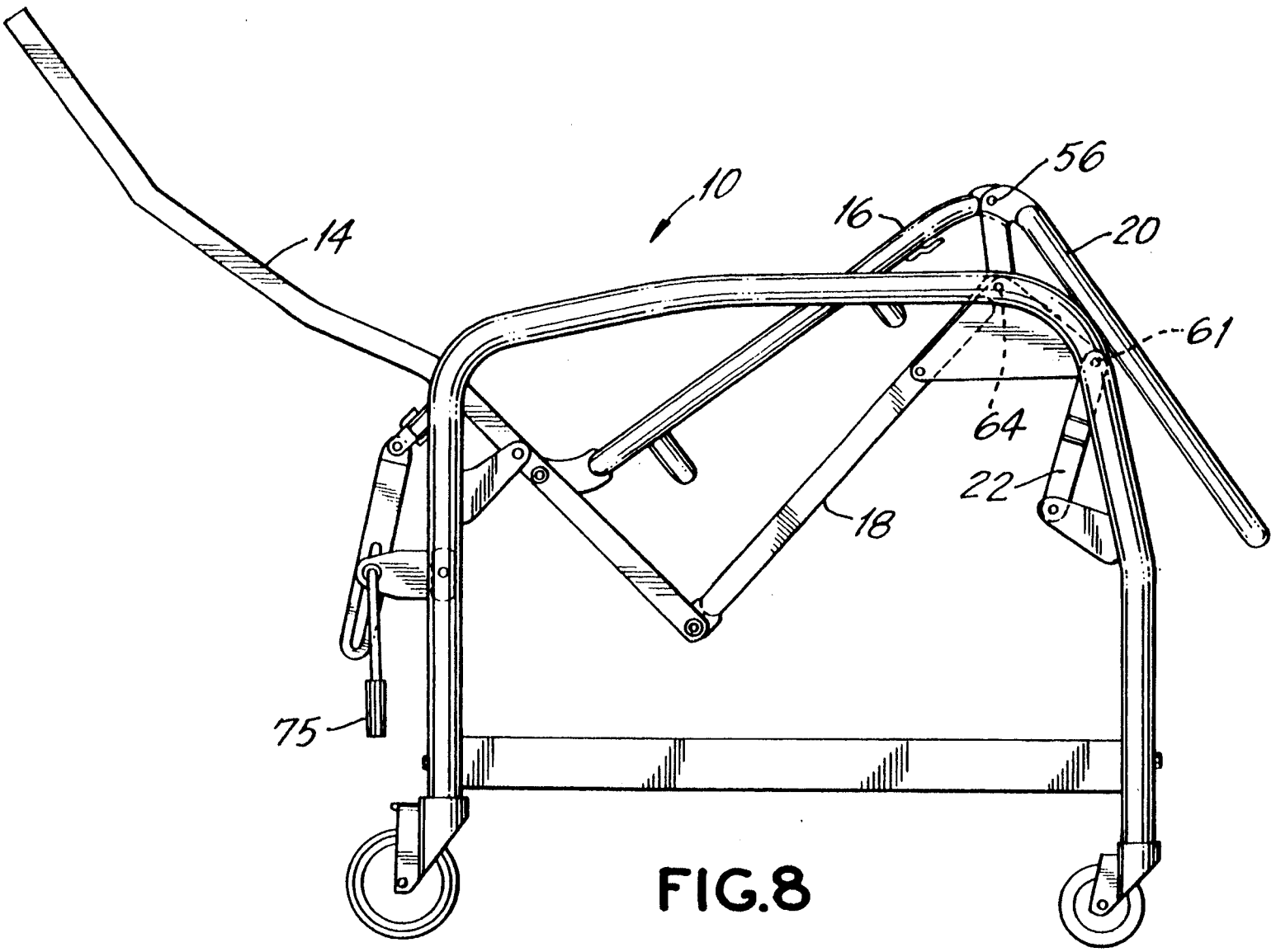
FIG. 8 is a side elevational view of the chair of FIG. 1, with the chair in a heart-rest position.

Referring now to FIG. 8, a "heart-rest" position is shown into which the chair 10 can be put with the assistance of an attendant. The heart-rest position is used to relieve pressure on the torso of an occupant of the chair 10 by raising the back frame assembly 14 and the front of the seat frame assembly 16. This placement of these components of the chair distributes pressure to the back and legs of the occupant, reducing pressure in the area of the heart. The heart-rest position is reached by pulling up the forward end of the seat frame assembly 16 and the top part of the back frame assembly 14. Handles at these locations may be provided to give the attendant a place to grab.

The heart-rest position is made possible by the circular movement of the .carrier links 22. As explained above, when the chair 10 reaches the full recline position, FIG. 7, it is not possible for the back frame assembly 14 to rotate counterclockwise any farther. If the occupant moves the chair 10 back into an intermediate recline or transport recline position, FIGS. 5 and 6, or to full upright position, FIGS. 1–3, the carrier links 22 reverse rotation and retrace their path, going now in a clockwise direction, and all the other links do likewise. If an attendant moves the chair 10 into heart-rest position, however, the carrier links 22 continue on their counter-clockwise path. The attendant lifts the front of the seat frame assembly 16, which causes the legrest assembly 20 to be elevated at pivot points 56. The carrier links 22 constrain the upward movement of the legrest assembly 20 through their connections to the drive link assemblies 18 at the bellcrank points 61 and pivot points 64, respectively. The bellcrank points 61 on the carrier links 22, now traveling the upper arc of their circular motion around pivot points 66, travel in a rearward direction, pushing the drive link assemblies 18 back, at bellcrank points 61, which movement in turn causes the back frame assembly 14 to rotate in a clockwise direction. The backward movement of the drive link assemblies 18, being attached to the legrest assembly 20 at pivot points 64, causes the legrest assembly 20 to pivot clockwise around pivot points 56.

At the beginning of the movement toward heart-rest position, the carrier links 22 complete the right side arc of their circular path, displacing the bellcrank points 61 mostly in a vertical direction, which causes little horizontal displacement of the drive link assemblies 18 and thus little clockwise rotation of the back frame assembly 14. As the movement of the carrier links 22 continues, however, the bellcrank points 61 trace more of the top arc of their circle, thereby rapidly horizontally displacing the drive link assemblies 18 and rotating the back frame assembly 14 in a clockwise direction. At the same time, the horizontal movement of the drive link assemblies 18 overtakes the horizontal movement of the seat frame assembly 16, and pivot points 56 begin to act more as points of rotation for the legrest assembly 20, since pivot points 64 are being pulled to the rear by the rearward movement of the drive link assemblies 18 and carrier links 22. The legrest assembly 20 therefore rotates in a clockwise direction.

The locking device 68 must be applied, by rotating the handle 75, to keep the chair 10 in the heart-rest position since the chair 10 has been forced out of its natural reclining balance by the action of the attendant, and will lapse back into it if not restrained. The chair 10 need not be locked in the exact position shown in FIG. 8; a position of greater or lesser degree may be desired.

Referring once again to FIG. 1, the chair 10 may be taken apart and folded for shipment by removing the bolts 27 attaching the longitudinal supports 26 of the base frame assembly 12 to the armrest bars 24, thus removing the H-frame comprising the longitudinal supports 26 and cross supports 28 and 29. The locking device 68 may be removed from its attachment to the chair by removing the support beam 30 (through removal of the bolts 33), and by removing the bolt 84 in the back support bar 38. The support beam 30 is detached from the armrest bars 24 by removing the bolts 33. The back frame assembly 14, seat frame assembly 16, drive link assemblies 18, legrest assembly 20, and carrier links 22 may then be disassembled thereby creating a compact package for shipping.

Figure 9:
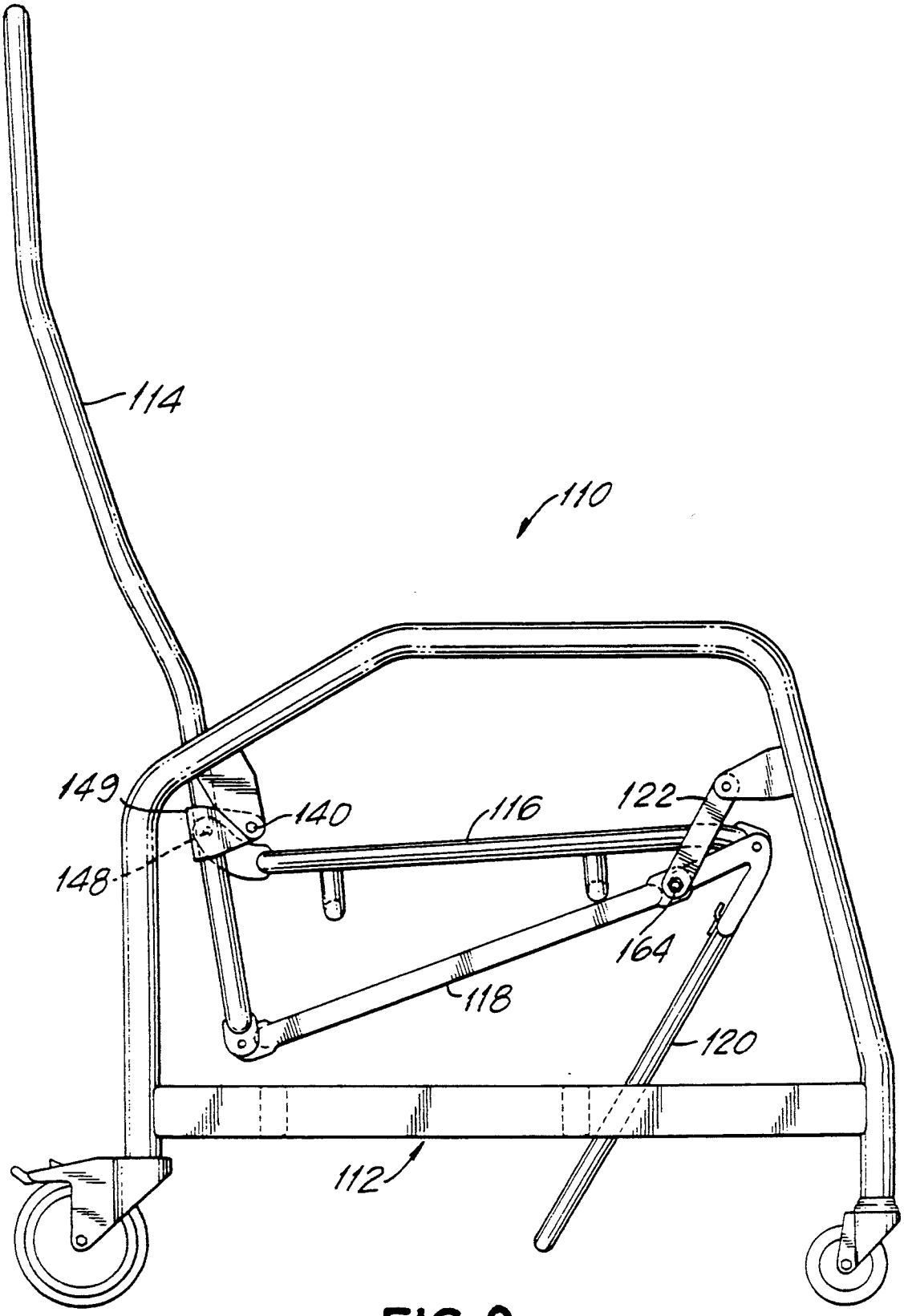
FIG. 9 is a side elevational view of a reclining chair having a second embodiment of a reclining chair mechanism according to the present invention, with the chair in a full upright position.

FIG. 9 depicts another reclining chair 110 according to the present invention, and illustrates some of the modifications which may be made to the linkage while still remaining within the scope of the invention. The chair 110 comprises a base frame assembly 112, a back frame assembly 114, a seat frame assembly 116, drive links 118, a legrest assembly 120, and carrier links 122. The seat frame assembly 116 is pivotally attached to the back frame assembly 114 at pivot points 148. Level with pivot points 148, brackets 149 project forwardly from the back frame assembly 114, pivotally attaching the back frame assembly 114 to the base frame assembly 112 at pivot points 140. The effect is to make pivot points 140 and 148 level to each other.

The carrier links 122 and legrest assembly 120 attach at coincident pivot points 164 on the drive links 118. The carrier links 122 are thus attached to the drive links 118 at higher points than their counterparts in FIGS. 1–8, which causes the attachment of the carrier links 122 to the base frame assembly 112 to be higher as well, raising much of the carrier links 122 above the level of the seat frame assembly 116.

A locking device is not needed for the chair 110 to be balanced in closed position. Additionally, the chair 110 does not need a locking device to assume and remain in any reclined position. The chair 10 of FIGS. 1–8 is capable of similar action without activation of the locking device 68. However, without a locking device, the chair 110 will not be able to remain in a heart-rest position, though it will be able to reach one in the same manner as the chair 10 in FIGS. 1–8.

Figure 10:
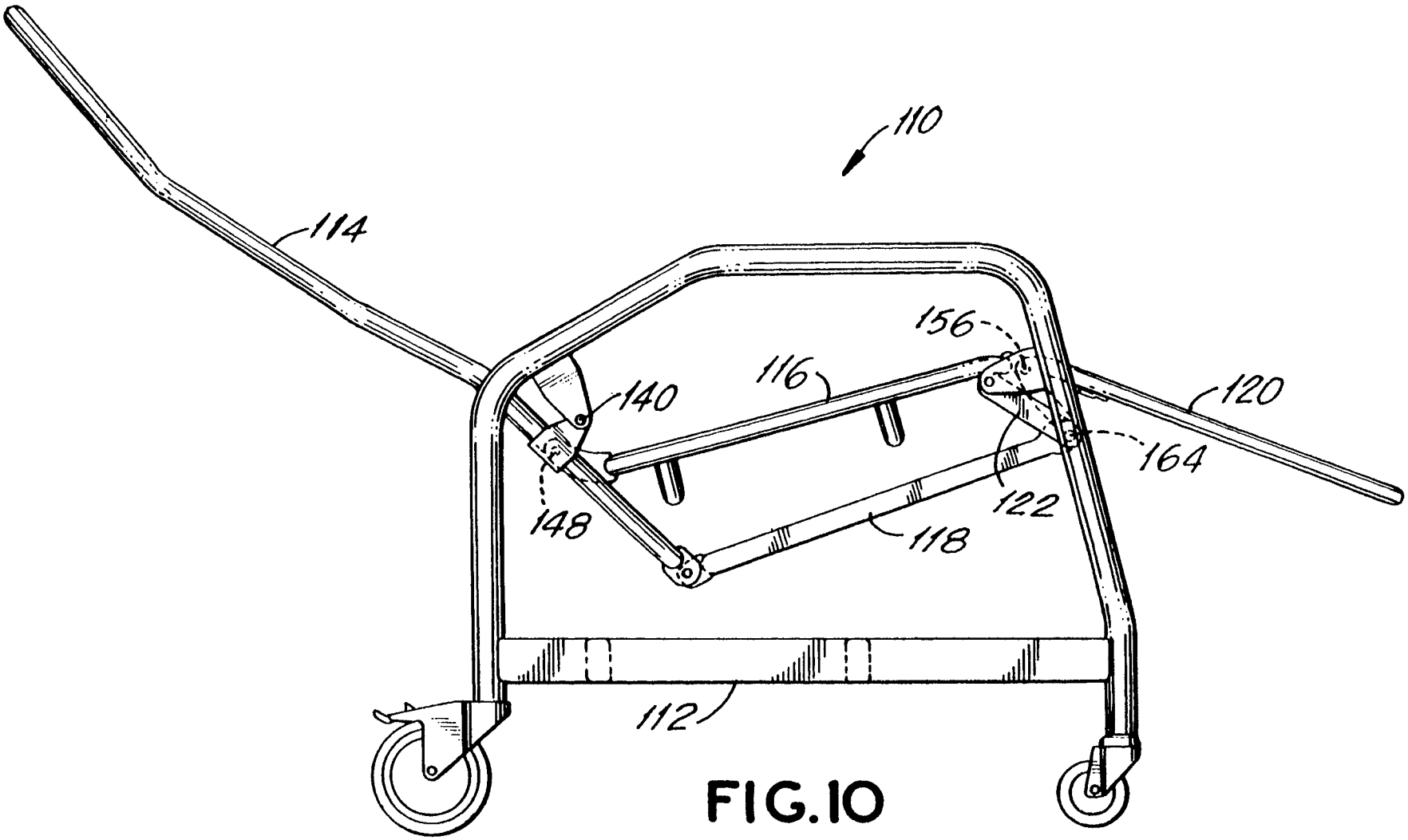
FIG. 10 is a side elevational view of the chair of FIG. 9, with the chair in an intermediate recline position.
Figure 11:
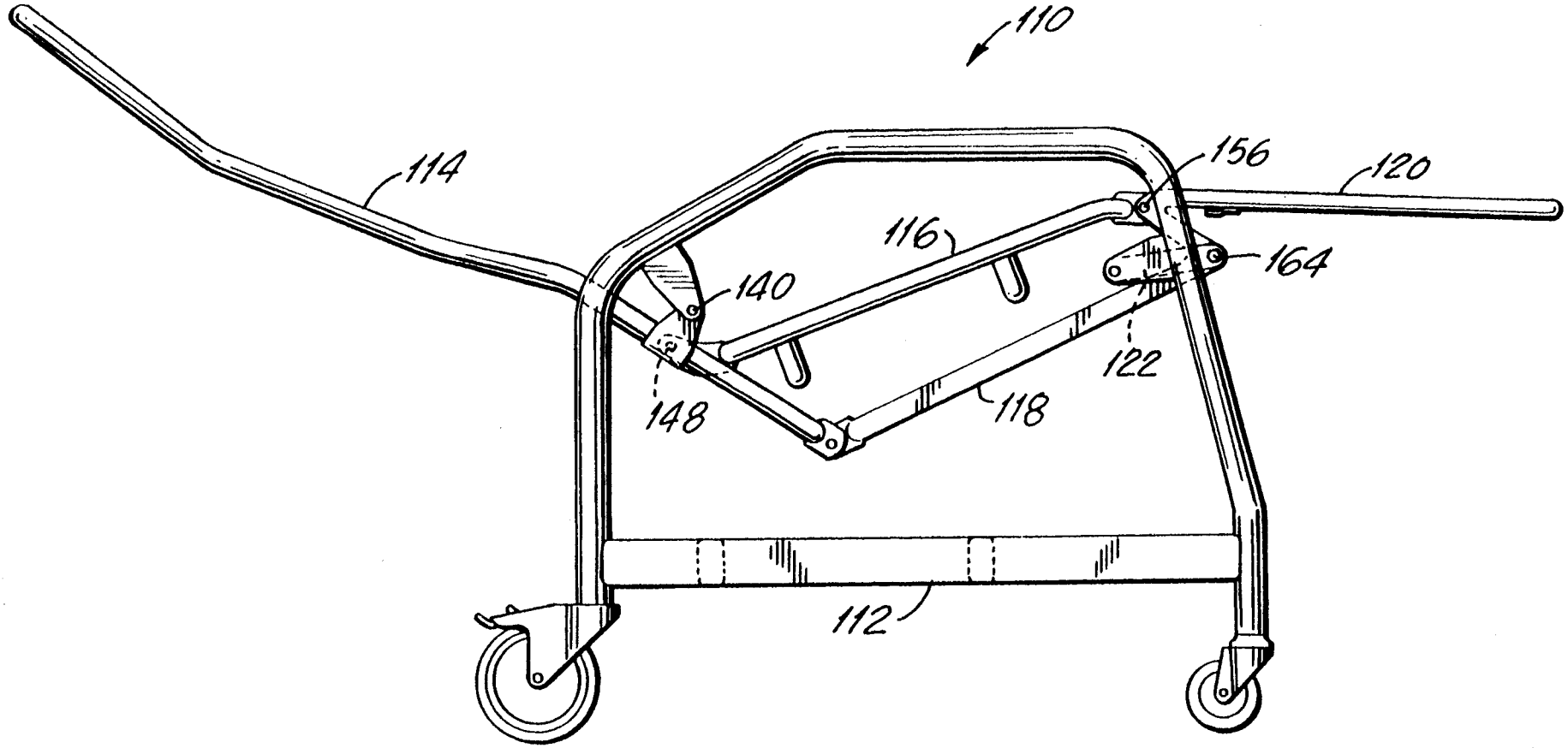
FIG. 11 is a side elevational view of the chair of FIG. 9 with the chair in a full recline position.

Referring to FIGS. 10 and 11, showing the chair 110 in intermediate and full recline positions, the configuration of the drive links 118, the carrier links 122, and the legrest assembly 120 will not cause any appreciable difference in the way the chair 110 reclines, as compared to the chair 10 in FIGS. 1–8. Since the carrier links 122 are attached to a different part of the drive links 118, the physical movement of the links takes a correspondingly shifted path, but the nature of movement remains the same. Other configurations can be used which do change the nature of rotation, but to a minimal degree, such as attaching the legrest assembly 120 at another point on the carrier links 122 instead of coincident pivot points 164, or attaching the carrier links 122 at another point on the legrest assembly 120, or on drive links 118, instead of on coincident pivot points 164. Other arrangements can be employed, as will be apparent to those skilled in the art.

The changed location of the attachment of the seat frame assembly 116 to the back frame assembly 114 will cause a slight change in the nature of the movement of the linkage. As the back frame assembly 114 pivots around the base frame assembly 112 at points 140, pivot points 148 describe a circle around pivot points 140, just as pivot points 48 describe a circle around pivot points 40 in FIGS. 1–7. However, since pivot points 148 are level with pivot points 140 in full upright position and thus travel the left side arc of the circle during initial activation, the initial rotation of the back frame assembly 114 will push the seat frame assembly 116 forward less than the seat frame assembly 16 is pushed during corresponding movement of the chair 10 in FIGS. 1–8, whereas while rotation continues, as shown in FIG. 10, pivot points 148 will begin to describe the lower arc of the circle and impart more forward movement to the seat frame assembly 116. Since the seat frame assembly 116 moves forward less during initial reclining, its points of attachment to the legrest assembly 120, pivot points 156, will act more as points of rotation for the legrest assembly 120 driven by the drive links 118. Since the seat frame assembly 116 moves forward relatively more during subsequent recline, pivot points 156 will act less as points of rotation. The net effect is to make the rotation of the legrest assembly 120 slightly less uniform during reclining action than the rotation of the legrest assembly 20 in FIGS. 1–8.

The chair 110 can be placed in a heartrest position in a similar manner to the chair 10 in FIGS. 1–8.

To complete construction of the chair, the seat frame, back frame, and legrest may be covered by an elastomeric suspension such as "ULTRAFLEX" (a registered trademark of Ultraflex Co., High Point, North Carolina), or by other elastic webbing, which may take the form of sleeves which slide onto the back frame, seat frame, and legrest. The webbing may then be covered with a relatively thin, foam filled pad of proper weight and compression, resulting in a reasonably high level of comfort for the occupant.

One of the armrest bars may be made to pivot to allow for egress from the chair at the side. Such pivoting arms are useful, e.g., for the elderly when the chair is used in home care or nursing homes.

Many other embodiments of the present invention are possible. For example, all components of the linkage may be composed of flat plates, bent as necessary to accommodate the movement of the linkage. In such a configuration, the linkage would be installed on each side of the chair, the right side being the mirror image of the left, as is standard in the art. The back, seat, legrest, and other components of the chair would then be attached to the linkage. Offset points, such as bellcrank points 61, may be added to aid in the reclining balance or to change the location of links. Other variations will be apparent to those skilled in the art.

A lap table may be added to the chair, as well as additional accessories, including footrests, an intravenous feeding receptacle and lock, head and body bolsters, a hook for fluid bags, oxygen tank racks, and foot-drop prevent devices. A wider, stronger frame and raised hand supports at the front of the arms may be used for a chair intended for use with the grossly overweight. Addition of side tables and adaptation of the linkage for movement into a "Trendelenburg" position, in which the feet are elevated above the level of the heart, would make the chair more useful for clinical care. The addition of two self-propelled wheels to the frame, the wheels being preferably 24 inches in diameter, in conjunction with removable footrests and wheel locks, will convert the chair into a wheelchair recliner.

My invention is defined by the following claims:

I claim:

1. A reclining chair comprising:

a back frame;

a seat frame having a front end and a back end, the back end being pivotally attached to the back frame;

a legrest pivotally attached directly to the front end of the seat frame, and positioned at an acute angle from vertical under the seat frame when the chair is in an upright position, whereby the legrest effectively is a continuous extension of the seat;

a base frame to which the back frame is pivotally attached;

a drive link pivotally attached at a first end to the back frame and at a second end to the legrest;

and a carrier link pivotally attached at a first end to the base frame and at a second end to an offset point on the second end of the drive link.

2. The reclining chair mechanism of claim 1, further comprising means for locking the back rest to the base frame to prevent relative movement in two directions of the back frame, seat frame, base frame, drive link, carrier link, and legrest.

3. The reclining chair of claim 1, further comprising a drive link pivotally attached to the back frame and pivotally attached to the legrest, whereby the drive link drives the movement of the legrest during reclining movement, and further comprising a carrier link, pivotally attached to the base frame at a first pivot point and pivotally attached to the drive link at a second pivot point, whereby a distance between the first and second pivot points constrains the movement of the legrest during reclining movement.

4. The reclining chair mechanism of claim 1, wherein the base frame is pivotally attached to the back frame above a point where the seat is pivotally attached to the back frame when the chair is in a full upright position.

5. The reclining chair mechanism of claim 1, wherein the base frame is pivotally attached to the back frame in a same horizontal plane where the seat frame is pivotally attached to the back frame when the chair is in a full upright position.

6. A reclining chair mechanism, comprising:

a stationary base;

a back frame;

means for pivotally attaching the back frame to the stationary base;

a seat frame;

means for pivotally attaching the seat frame to the back frame at a point separate from the attachment point of the back frame to the base;

a drive link;

means for pivotally attaching the drive link to the back frame, located below the means for attaching the seat frame to the back frame;

a connector link;

means for pivotally attaching the connector link to the seat frame, located in front of the means for attaching the seat frame to the back frame;

means for pivotally attaching the connector link directly to the drive link, located in front of the means for pivotally attaching the drive link to the back frame;

a carrier link;

means for pivotally attaching the carrier link to the stationary base; and means for pivotally attaching the carrier link to the drive link, located in front of the means for attaching the drive link to the back link.

7. The reclining chair mechanism of claim 6, wherein the means for pivotally attaching the carrier link to the drive link is a point on the drive link offset from the means for pivotally attaching the connector link directly to the drive link.

8. The reclining chair mechanism of claim 6, further comprising a legrest secured to the connector link.

9. The reclining chair mechanism of claim 8, wherein the carrier link is pivotally attached to the drive link coincident to the point where the connector link is pivotally attached to the drive link.

10. The reclining chair mechanism of claim 6, wherein the back frame is pivotally attached to the base above a point where the seat frame is pivotally attached to the back frame when the chair is in a full upright position.

11. The reclining chair mechanism of claim 6, wherein the back frame is pivotally attached to the base in a same horizontal plane where the seat frame is pivotally attached to the back frame when the chair is in a full upright position.

12. A reclining chair, comprising:

a base frame, which comprises a base support and two curved armrest bars attached to the base support;

a U-shaped back frame, each arm of which is pivotally attached to one of the armrest bars, which pivots backwardly during reclining action;

a seat frame, including two length supports and a cross support, each length support being pivotally attached to an arm of the back frame at a point below the point at which the back frame and the base frame are attached, whereby when the back frame pivots backwardly, the point at which the seat frame is attached to the back frame describes a circle around the point at which the back frame and the base frame are attached;

two drive links, each of which is pivotally attached to the bottom of each arm of the back frame, whereby when the back frame pivots backwardly, the point at which the drive links are attached to the back frame describes a circle around the point at which the back frame and the base frame are attached;

a substantially U-shaped legrest having hooked ends, pivotally attached to the front of the drive links at its ends, and pivotally attached to the front of the seat frame at the apices of the hooks, whereby the forward movement of the drive links causes the legrest to rotate around the points at which the legrest is attached to the seat frame, and whereby the legrest is adapted to angle underneath the seat frame when the chair is in closed position; and two carrier links, each of which pivotally attaches at its upper end to one of the armrest bars, and at its lower end to one of the drive links, whereby the drive links cause the carrier links to pivot around their attachments to the armrest bars.

13. The reclining chair mechanism of claim 12, wherein the two curved armrest bars are removably attached to the base support, and wherein the back frame and carrier links are removably attached to the base frame, and wherein the back frame, seat frame, drive links, legrests, and carrier links pivot closely together to form, with the base support and armrest bars, a compact unit for shipping.

14. The reclining chair mechanism of claim 12, further comprising a lock for locking the mechanism into any position throughout the range of motion of the mechanism, comprising a plurality of plates slidably disposed at a first end on the base frame and disposed at a second end on the back frame, a plurality of washers disposed adjacent to and between the plates at said first end, and means for pressing said washers against said plates to prevent movement of the plates.

15. A reclining chair mechanism, comprising:

a base frame having a rear section and a front section;

a back link having a first end and a second end;
means for pivotally attaching the back link to the rear section of the base frame at a point intermediate the first end and the second end of the back link;
a seat link having a front and a rear;
means for pivotally attaching the rear of the seat link to the back link at a point intermediate the first end and the second end of the back link;
a legrest link;
means for pivotally attaching the legrest link to the front of the seat link;
a drive link having a front and a rear;
means for pivotally attaching the rear of the drive link to the first end of the back link;
a carrier link;
means for pivotally attaching the carrier link to the front section of the base frame;
means for pivotally attaching the front of the drive link to the carrier link; and
means for pivotally attaching the legrest link directly to the drive link.

16. The reclining chair mechanism of claim 15, wherein the means for pivotally attaching the back link to the base frame defines a first pivot point and the means for pivotally attaching the rear of the seat link to the back link defines a second pivot point, wherein the second pivot point is below the first pivot point when the chair mechanism is in a full upright position.

17. The reclining chair mechanism of claim 30, wherein the means for pivotally attaching the front of the drive link to the carrier link defines a third pivot point, wherein the third pivot point is on a point on the front of the drive link offset from the means for pivotally attaching the legrest link directly to the drive link.

18. The reclining chair mechanism of claim 15, further comprising means for locking the back rest to the base frame to prevent relative movement in two directions of the back link, the seat link, the base frame, the drive link, the carrier link and the legrest link.

19. The reclining chair mechanism of claim 15, wherein the legrest link is angularly disposed below the seat link.

20. The reclining chair mechanism of claim 15, wherein the back link is pivotally attached to the base frame in a same horizontal plane where the seat link is pivotally attached to the back link when the chair is in a full upright position.

21. The reclining chair mechanism of claim 15, wherein the carrier link is pivotally attached to the drive link coincident to the point where the legrest link is pivotally attached to the drive link.

22. A reclining chair mechanism, comprising:
a base frame having a rear section and a front section;
back link having a first end and a second end;
means for pivotally attaching the back link to the rear section of the base frame at a point intermediate the first end and the second end of the back link;
a seat link having a front and a rear;
means for pivotally attaching the rear of the seat link to the back link at a point intermediate the first end and the second end of the back link, and below the means for pivotally attaching the back link to the rear section of the base frame when the chair mechanism is in a full upright position;
a legrest link;
means for pivotally attaching the legrest link to the front of the seat link;
a drive link having a front and a rear;
means for pivotally attaching the rear of the drive link to the first end of the back link;
a carrier link;
means for pivotally attaching the carrier link to the front section of the base frame;
means for pivotally attaching the front of the drive link to the carrier link; and
means for pivotally attaching the legrest link to the drive link.

23. The reclining chair mechanism of claim 22, wherein the means for pivotally attaching the front of the drive link to the carrier link is on a point on the front of the drive link offset from the means for pivotally attaching the legrest link to the drive link.

24. The reclining chair mechanism of claim 22, wherein the carrier link is pivotally attached to the drive link coincident to the point where the legrest link is pivotally attached to the drive link.

25. A reclining chair mechanism comprising:
a back frame;
a seat having a front end and a back end, the back end being pivotally attached to the back frame;
a legrest pivotally attached directly to the front end of the seat frame, and positioned at an acute angle from vertical under the seat frame when the chair is in an upright position, whereby the legrest effectively is a continuous extension of the seat;
a base frame to which the back frame is pivotally attached;
a drive link pivotally attached at a first end to the back frame and at a second end to the legrest; and
a carrier link pivotally attached at a first end to the base frame and at a second end to the drive link at a point coincident to the point where the drive link is pivotally attached to the legrest.

* * * * *

UNITED STATES PATENT AND TRADEMARK OFFICE

CERTIFICATE OF CORRECTION

PATENT NO. : 5,348,367

DATED : September 20, 1994

INVENTOR(S) : Ned W. Mizelle

It is certified that error appears in the above-indentified patent and that said Letters Patent is hereby corrected as shown below:

At Col. 5, line 8, "located 1,216" below" should read "located 1.216" below";

At Col. 5, line 41, "located 20,588" from " should read "located 20.588" from ";

At Col. 7, line 27, "collar 86 is" should read "collar 80 is"; and

At Col. 15, line 29, "of claim 30" should read "of claim 16".

Signed and Sealed this

Twenty-fourth Day of January, 1995

*Attest:*

Bruce Lehman

BRUCE LEHMAN

*Attesting Officer*

*Commissioner of Patents and Trademarks*